US010092792B2

(12) United States Patent
Kueker et al.

(10) Patent No.: US 10,092,792 B2
(45) Date of Patent: Oct. 9, 2018

(54) HIGH-INCLINE TREADMILL

(71) Applicant: True Fitness Technology, Inc., O'Fallon, MO (US)

(72) Inventors: Jared Kueker, Saint Charles, MO (US); Yu Hsin Wang, Taichung (TW); Kuo Ti Huang, Taichung (TW)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 15/860,164

(22) Filed: Jan. 2, 2018

(65) Prior Publication Data

US 2018/0140895 A1 May 24, 2018

Related U.S. Application Data

(63) Continuation of application No. 15/672,934, filed on Aug. 9, 2017, now Pat. No. 9,889,333, which is a (Continued)

(51) Int. Cl.
*A63B 22/02* (2006.01)
*A63B 22/00* (2006.01)
(Continued)

(52) U.S. Cl.
CPC ..... *A63B 22/0023* (2013.01); *A63B 22/0235* (2013.01); *A63B 23/0405* (2013.01);
(Continued)

(58) Field of Classification Search
CPC . A63B 22/02; A63B 22/0207; A63B 22/0214; A63B 22/0221; A63B 22/0228;
(Continued)

(56) References Cited

U.S. PATENT DOCUMENTS 2,399,915 A * 5/1946 Drake ..... A63B 22/02 482/54
4,974,831 A * 12/1990 Dunham ..... A63B 22/0023 482/54
(Continued)

FOREIGN PATENT DOCUMENTS

KR 20050087181 A 8/2005

OTHER PUBLICATIONS

International Search Report, International Patent Application No. PCT/US2015/066124, dated Mar. 28, 2016 (8 pages).
(Continued)

*Primary Examiner* — Loan H Thanh
*Assistant Examiner* — Rae Fischer
(74) *Attorney, Agent, or Firm* — Lewis Rice LLC

(57) ABSTRACT

A treadmill which utilizes provides for a connection between the floor stand and the treadbase which is toward the front end of the treadbase and provides for generally improved support of the front end of the treadbase at higher angles by providing that the lift mechanism is attached to the treadbase at two fixed points a fixed distance from each other. The lift mechanism then utilizes two different motions, the extension of an extension arm and the rotation of a rigid arm, to produce lift. The rotation of the rigid arm generally utilizes a wheel in an enclosed raceway attached to the floor stand.

11 Claims, 14 Drawing Sheets

Related U.S. Application Data continuation of application No. 14/971,475, filed on Dec. 16, 2015, now Pat. No. 9,764,184.

(60) Provisional application No. 62/094,702, filed on Dec. 19, 2014.

(51) Int. Cl.

| | |
|---|---|
| ***A63B 24/00*** | (2006.01) |
| ***A63B 23/04*** | (2006.01) |
| *A63B 71/06* | (2006.01) |
| *A63B 71/00* | (2006.01) |
| *A63B 21/005* | (2006.01) |
| *A63B 21/008* | (2006.01) |
| *A63B 22/04* | (2006.01) |

(52) U.S. Cl.

CPC ..... *A63B 24/0087* (2013.01); *A63B 21/0058* (2013.01); *A63B 21/0083* (2013.01); *A63B 21/0087* (2013.01); *A63B 22/04* (2013.01); *A63B 71/0054* (2013.01); *A63B 71/0622* (2013.01); *A63B 2071/0625* (2013.01)

(58) Field of Classification Search

CPC ..... A63B 22/0235; A63B 22/0242; A63B 22/0271; A63B 22/0278; A63B 22/0285; A63B 22/0292

See application file for complete search history.

(56) References Cited

U.S. PATENT DOCUMENTS

| | | | | |
|---|---|---|---|---|
| 5,352,167 | A | 10/1994 | Ulicny | |
| 5,591,106 | A | 1/1997 | Dalebout et al. | |
| 5,672,140 | A | 9/1997 | Watterson et al. | |
| 5,772,560 | A | 6/1998 | Watterson et al. | |
| 6,068,579 | A | 5/2000 | Killian et al. | |
| 6,743,153 | B2 | 6/2004 | Watterson et al. | |
| 6,761,667 | B1 * | 7/2004 | Cutler ..... | A63B 22/0023 482/51 |
| 6,830,540 | B2 * | 12/2004 | Watterson ..... | A63B 22/0023 482/51 |
| 6,843,757 | B2 | 1/2005 | Pan et al. | |
| 6,899,659 | B2 | 5/2005 | Anderson et al. | |
| 6,945,914 | B1 | 9/2005 | Cheng | |
| 6,974,404 | B1 | 12/2005 | Watterson et al. | |
| 7,344,481 | B2 | 3/2008 | Watterson et al. | |
| 7,537,549 | B2 | 5/2009 | Nelson et al. | |
| 2002/0094916 | A1 | 7/2002 | Wang et al. | |
| 2004/0138030 | A1 | 7/2004 | Wang et al. | |
| 2005/0032610 | A1 | 2/2005 | Nelson et al. | |
| 2007/0004561 | A1 | 1/2007 | Yoo | |
| 2007/0111864 | A1 | 5/2007 | Schmidt | |
| 2009/0111664 | A1 | 4/2009 | Kau | |
| 2013/0017929 | A1 | 1/2013 | Hendrickson et al. | |
| 2013/0123073 | A1 | 5/2013 | Olson et al. | |

OTHER PUBLICATIONS

Supplementary European Search Report, International Patent Application No. EP15870997.2, dated Jul. 2, 2018 (8 pages).

* cited by examiner

HIGH-INCLINE TREADMILL

CROSS REFERENCE TO RELATED APPLICATION(S)

This application is a Continuation of U.S. Utility patent application Ser. No. 15/672,934, filed Aug. 9, 2017, which is a Continuation of U.S. Utility patent application Ser. No. 14/971,475 filed Dec. 16, 2015 and now issued as U.S. Pat. No. 9,764,184, which claims the benefit of U.S. Provisional Patent Application Ser. No. 62/094,702, filed Dec. 19, 2014. The entire disclosure of all the above documents are herein incorporated by reference.

BACKGROUND OF THE INVENTION

1. Field of the Invention

This disclosure relates to the field of cardiovascular exercise machines. In particular, to treadmills which utilize a lifting mechanism with multiple fixed mounting points on the treadbase to permit for high-incline e.g. greater than 15% incline, of the treadbase.

2. Description of the Related Art

The benefits of regular aerobic exercise on individuals of any age are well documented in fitness science. Aerobic exercise can dramatically improve cardiac stamina and function, as well as lead to weight loss, increased metabolism, and other benefits. At the same time, aerobic exercise has often been linked to damaging effects, particularly to joints or similar structures, where the impact from many aerobic exercise activities can cause injury. Therefore, those involved in the exercise industry are continuously seeking ways to provide users with exercises that have all the benefits of aerobic exercise, without the damaging side effects.

One relatively low impact exercise is walking. Walking has a number of advantages over its faster relative, running. In particular, walking causes much less stress on body structures in the legs, feet, and hips. In a walking motion, the human body generally never completely leaves the ground while in a running motion, the body is suspending midair for a short period of time with each stride. Thus, while walking, knees and other structures absorb an impact from the foot's contact with a surface, but the entire weight of the individual is generally not absorbed by the body as it is in running. For this reason, walking is generally an acceptable exercise for a large number of people even for the elderly and those with joint or other issues. Further, the impact of walking can be further reduced by walking on a treadmill or other exercise device as opposed to walking outside. The treadbase of a treadmill can be purposefully engineered to absorb and reduce impact from footfalls, making the walking motion produce even less impact on the body.

Walking as an exercise, however, has a number of built-in limitations and these can be exaggerated when one is intending to walk on a machine in the home or gym such as a treadmill. Many of the problems relate to walking's built in limitations for strenuousness. The average human will generally naturally walk around 3 to 3.5 miles per hour and most humans cannot walk above 4 to 5 miles per hour without specific training. Generally, at higher speeds, the person has to switch to a running motion in order to maintain the desired speed. It is often accepted that speeds between 4 and 6 miles per hour require the average human to jog, while speeds above 6 miles per hour require a running motion. Humans can obtain very fast speeds while running with an average person being able to sprint at over 10 miles per hour. Further, some studies have indicated that any person's natural walking speed may be preferentially selected to minimize work for desired distance and time. Thus, natural walking as an exercise can be problematic because humans may naturally walk in a very efficient fashion, which can, minimize its exercise potential.

While a sustained speed of 4 mph can prove plenty strenuous for many people, for those looking for weight loss and strong cardiovascular workouts, walking, even at their top sustainable speed, can require a very long workout to be equivalent to a relatively short run and the time or such a workout may not be available. The time required by walking can be particularly problematic for home exercise machines where the average user can find walking in-place for a long period of time boring since there is no changing scenery or people to talk to.

For those who are interested in using an exercise machine for strenuous walking, the common way to increase the strenuousness of the activity is to increase the incline of the treadbase forcing them to consistently walk "uphill" or engage in more of a hiking or climbing exercise. Walking at even a relatively slight angle above neutral (or level) has been shown to dramatically increase the strenuousness of the walking. However, traditional treadmills often have problems producing higher inclines. Specifically, traditional treadmills could generally only obtain a maximum incline of around 10-15 percent. In many cases, this was due to the method of lifting and inclining the treadbase.

Traditionally, in order to provide for robust mechanical lifting and a solid treadbase support, treadbases lifted by raising the front end directly upward or upward and forward using a lift mechanism located under the front end of the treadbase. This results in the backend of the treadbase "sliding" across die floor because the treadbase generally cannot alter in length during the raising. This type of raising provides the treadmill with a good stable structure and mechanically simple lift, but it is inherently limited because the lift mechanism (which is generally some form of extending or rotating arm) can generally extend to a maximum of double its totally retracted length and the retracted length needs to fit under the treadbase at its neutral position. Thus, incline was often limited by a desire to keep the treadbase close to the floor in its neutral position. To get high-incline, prior devices often used a fixed high incline (with a neutral position above 15% incline) to avoid having to lift and lower the treadbase and then provided a "stair belt" which simulated climbing stairs as opposed to walking up an incline.

Recently, a new class of high-incline treadmills, which are often marketed as climbing or hiking simulators, have gained in popularity. These devices provide a treadbase without stair structures, and allow for the treadbase to be tilted above the 15% position. For the purposes of this disclosure, a high-incline treadmill is a treadmill which is capable of having the treadbase and an associated flat (as opposed to stair) endless belt being run thereon, tilt to an angle of greater than 15% from neutral, greater than 20% of neutral, or greater than 30% of neutral and which can depress the treadbase to the neutral position of 0% (or lower) as well. To put it another way, a high-incline treadmill will generally have a variable range of incline greater than 15%, greater than 20%, or greater than 30%. Generally, the treadbase will have a maximum incline of around 30 to 45%, but this is by no means required and higher inclines can be used. However, above 45%, a user maintaining sufficient friction with a flat belt to not slip can be difficult.

Previously, high-incline treadmills shared a couple of commonalities in lift systems which all have specific problems. Prior designs of high-incline treadmills generally utilize a single fulcrum arm to raise and lower the treadbase. Like in traditional treadmills, for mechanical simplicity this is usually an extendable arm (e.g. utilizing a screw or worm drive, hydraulics, or pneumatics) mounted with one end rotatably affixed to the floor stand and one end rotatably affixed to the lower surface of the treadbase. This system is simple as it allows for the drive mechanism to extend or retract (changing its length) and the length change resulted in the treadbase being tilted upward because the only other adjustable variable is the relative angles of the various components. Basically, the systems created a triangular arrangement with two fixed side lengths and one variable (the length of the extension arm) and the ability to alter internal angles.

These types of systems, however, generally require that the extendable arm be mounted toward the rear of the treadbase and the front of the floor stand to obtain enough angle adjustment to get high-incline. With this type of arrangement, the fixed portion of the triangular distance related to the treadbase is shortened (because not all the length of the treadbase is used). Thus, the back of the treadbase is effectively a lever to increase the distance the front end is raised. However, the arrangement generally means that the treadbase is tilted from a position toward the rear of the treadbase. While this provides for a dramatic increase in angle for a relatively small extension, it also means that the front of the treadbase is generally not as strongly supported and can therefore bounce significantly more than may be desirable when a user walks or runs on the treadmill.

Some alternative devices have been proposed, but, for the most part, they rely on the same principle of getting the higher angle by pushing toward the rear of the base. These designs can attach an arm toward the rear of the treadbase in rotational fashion and then rotate the arm with the extension drive to a greater angle (while keeping the length constant). Those few devices which have attempted to connect a support toward the forward end, generally have the support moveably attached to the forward end of the treadbase on rollers or in another similar fashion. Thus, as the incline increases, the connection point to the treadbase will move further back, again suspending the end of the treadbase at higher inclines leading to increased bounce and flexibility of the treadbase at higher inclines, particularly toward the forward end.

SUMMARY OF THE INVENTION

The following is a summary of the invention, which should provide to the reader a basic understanding of some aspects of the invention. This summary is not intended to identify critical elements of the invention or in any way to delineate the scope of the invention. The sole purpose of this summary is to present in simplified text some aspects of the invention as a prelude to the more detailed description presented below.

Because of these and other problems in the art, Described herein is a high incline treadmill which utilizes a different mechanism for raising the treadbase to an incline. The device generally provides for a connection with the treadbase which is toward the front end of the treadbase and provides for generally improved support of the front end of the treadbase at higher angles by providing that the lift mechanism is attached to the treadbase at two fixed points a fixed distance from each other. The lift mechanism then utilizes two different motions, the extension of an extension arm and the rotation of a rigid arm, to produce lift.

Described herein, among other things is a treadmill comprising: a floor stand; a treadbase including an endless belt thereon; a motor for moving the endless belt; and a lifting mechanism for rotating the treadbase relative to the floor stand about a point of rotation, the lifting mechanism comprising: a lift motor, attached at a fixed position to the treadbase; an extension arm attached at a first end to a fixed position on the treadbase, the extension arm increasing and decreasing in length based on action of the motor; and a rigid arm, the rigid arm attached at a first end to a fixed position on the treadbase, a second end of the extension arm being attached to the rigid arm at a fixed position on the rigid arm; wherein extension of the extension arm results in the treadbase rotating relative to the floor stand about the point of rotation.

In an embodiment of the treadmill, a second end of the rigid arm comprises wheels.

In an embodiment of the treadmill, the wheels roll on a surface upon which the floor stand is resting when the extension arm extends.

In an embodiment of the treadmill, the wheels are within an enclosed raceway, the enclosed raceway being attached to the floor stand.

In an embodiment of the treadmill, the motor of moving the endless belt is within a cage and the cage is attached to the treadbase.

In an embodiment of the treadmill, the rotation point is toward a base of the cage and the cage is attached toward a top of the cage to the treadbase.

In an embodiment of the treadmill, the endless belt rotates on the treadbase about a front roller and a rear roller.

In an embodiment of the treadmill, the rotation point is located horizontally behind an axle of the rear roller.

In an embodiment of the treadmill, the rotation point is located vertically below the axle of the rear roller.

In an embodiment of the treadmill, the treadbase rotates relative to the floor stand to a greater than 15% incline.

In an embodiment of the treadmill, the treadbase rotates relative to the floor stand to a greater than 20% incline.

In an embodiment of the treadmill, the treadbase rotates relative to the floor stand to a greater than 25% incline.

In an embodiment of the treadmill, the treadbase rotates relative to the floor stand to a greater than 30% incline.

In an embodiment the treadmill further comprises, a step located at a rear of the floor, stand.

In an embodiment of the treadmill, the step is remove ably attached to the floor stand.

DETAILED DESCRIPTION OF THE PREFERRED EMBODIMENT(S)

Figure 1:
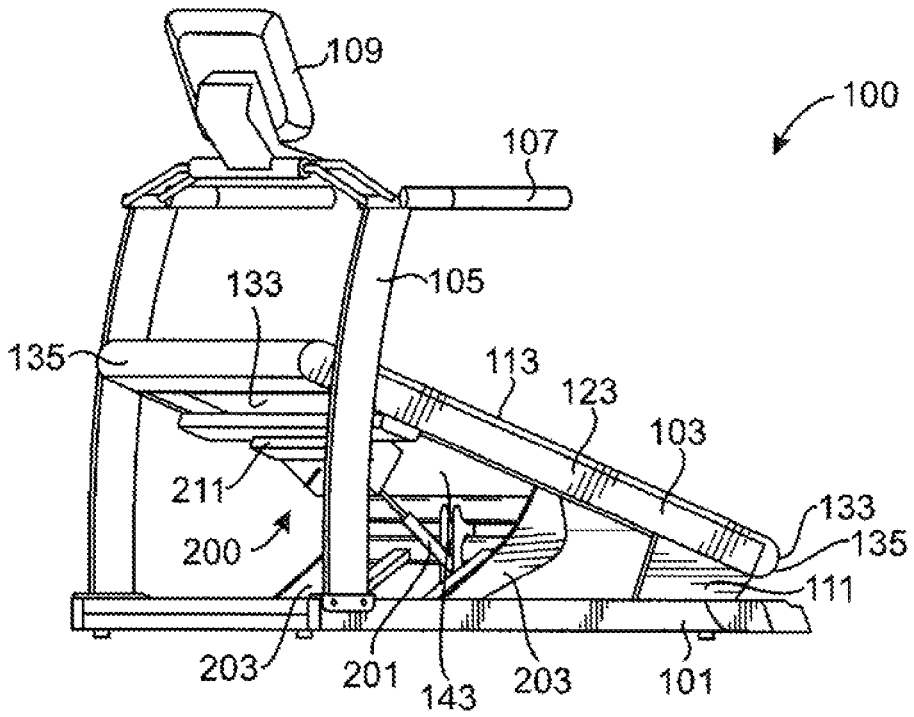
FIG. 1 shows a front angular perspective view of an embodiment of a high-incline treadmill.
Figure 2:
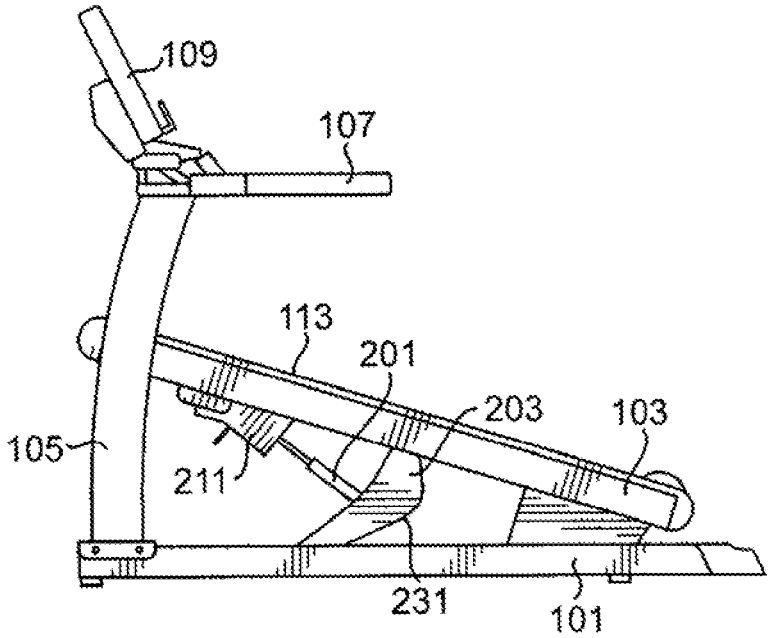
FIG. 2 shows a side view of the high-incline treadmill of FIG. 1.
Figure 3:
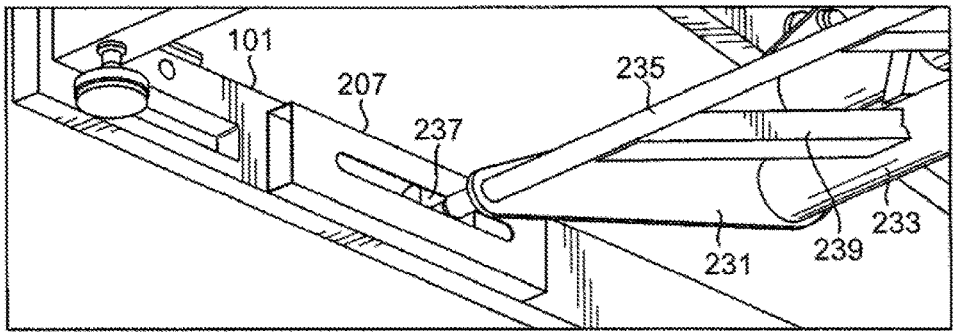
FIG. 3 shows an underside view of the high-incline treadmill of FIG. 1 showing detail of the wheel raceway.
Figure 4:
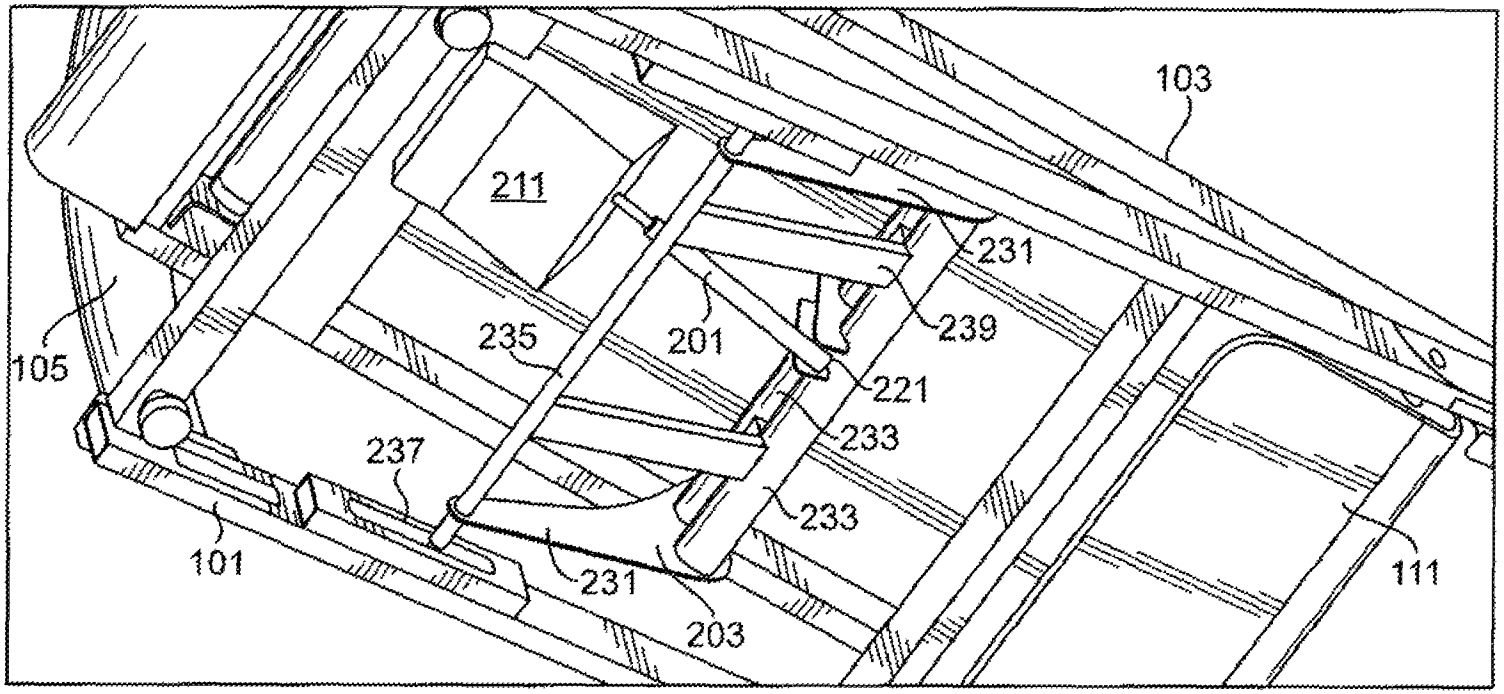
FIG. 4 shows an underside view of the high-incline treadmill of FIG. 1 showing detail of the lift mechanism.
Figure 5:
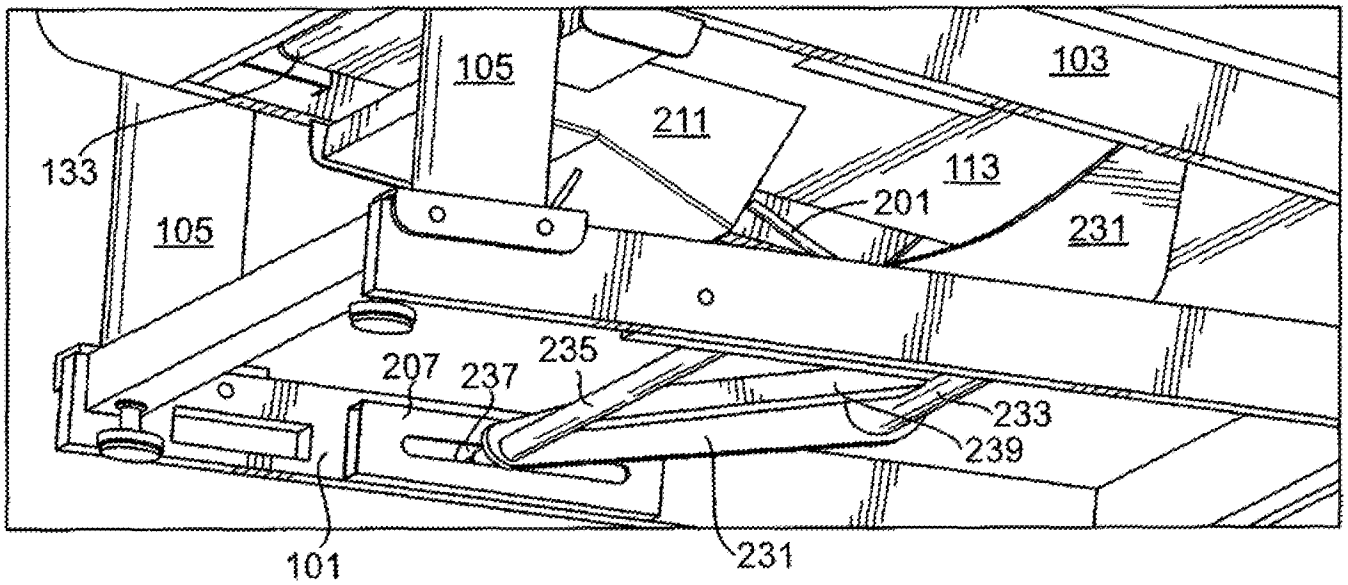
FIG. 5 shows a side perspective view of the embodiment of FIG. 4.

FIGS. 1 and 2 provide an overview of a first embodiment of a treadmill and specifically a high-incline treadmill (100) utilizing an embodiment of a lift mechanism (200) utilizing two points of fixed contact with the treadbase. In the depicted embodiment, the treadmill (100) comprises a floor stand (101) which is generally composed of a series of pipes or rails arranged in the form of a hollow parallelogram. Attached to the floor stand (101) is a treadbase (103) which is firmed of two side rails (123) which support two rollers (133) toward either end. As depicted there are also guards (135) which cover the ends of the treadbase (103) to inhibit unintended contact with moving parts.

There is then a flat endless belt (113) positioned around the rollers (133) which will act as the walking surface of the user. The belt (113) will often pass in close proximity and above a deck (143). The deck (143) will act to support the weight of the user and will provide the surface upon which their feet impact through the belt (113) when a user is walking or running on the belt (113). Deck (143) is generally necessary to support the mass of the user, however, decks can be of substantially different construction and form from solid piece monolithic constructions, to multi-piece assemblies, to flexible or configurable arrangements depending on the intended uses of the treadmill, cost profiles, and desired capabilities. For purposes of this disclosure, the deck (143) can generally be of any form known to the art or later discovered.

The belt (113) is driven by a motor (111) which, in the depicted embodiment of FIGS. 1-8, is mounted at the rear of the floor stand (101) and is connected to the treadbase (103). Alternatively, the motor (111) need not be connected to the floor stand (101), but is instead mounted in a cage (311) attached to the treadbase (103) as is shown best in the embodiments of FIGS. 9-12. Alternatively, the motor (111) may be allowed to rest on the floor under the treadbase (103) or could be mounted to the floor stand (101) under, behind, or in front of the treadbase (103).

If mounted on the floor or floor stand (101), the rear roller (133) may effectively act as a rotational axis for the back end (the end to the right of FIG. 2) of the treadbase (103) and the treadbase (103) may rotate relative to the motor (111) toward the back. This is a very logical arrangement, because the motor (111) will often be rotationally connected to the rear roller (133), and the drive mechanism of the motor (111) will operate in the same manner on the roller (133) regardless of the angle of the treadbase (103) to the motor (111). Thus, the treadbase (103) can angle upward around the axle of the rear roller (133) while still maintaining constant connection of the motor (111) which can be immobile during this rotation.

It should be noted herein that this disclosure utilizes the terms "front" and "back" of the treadmill (100) and other structures. As this disclosure is primarily discussing a high-incline (as opposed to high-decline) treadmill (100), it is expected that the front of the treadbase (103) will need to be capable of being arranged at a physically higher relative location to the rear of the treadbase (103) in a high-incline arrangement. To put this another way, the front of the treadbase (103) will need to move vertically away from the floor stand (101) (if the floor stand (101) is considered horizontal) by a greater amount than the rear of the treadbase (103) moves vertically away in the same time interval.

A user walking forward (facing the front of the treadbase (103)) on this treadmill (100) would, therefore, be walking up an incline. However, if the user was to rotate, the treadmill (100) would provide a high-decline exercise, which may be useful to some users. Further, it should be noted that the same structure discussed herein can be used for a high-decline treadmill simply be reversing the positioning of the components used by the user. Specifically, the handles (107) and controller (109). For purposes of this disclosure "back" generally means the portion of the treadmill to the right on FIG. 2 and "front" is the portion of the treadmill toward the left of FIG. 2.

The depicted treadmill (100) will also include a pair of support arms (105). These are arranged toward the front of the treadmill (100) and will generally serve to provide for a support for components to be used by a user standing, walking, or running on the treadbase (103). The support arms (105) terminate at a top which will generally comprise at least one handle (107) which the user can grip to provide stability, and a console (109) which can be used to control the motors (111) and (211) and other components of the treadmill (100). The console (109) may also be equipped to provide comfort features as is standard in the industry including providing a rack to bold reading material, a screen to display video, and/or an audio player.

In an embodiment, the front end of the treadbase (103) can be slideably attached to the support arms (105) so that the arms (105) provide for a housing for a connection to the front end of the treadbase (103), but this is by no means required and will generally not be the arrangement. In another alternative embodiment, the support arms (105) may be attached to the treadbase (103) instead of the floor stand (101), but this is generally not preferred as it can result in instability at high inclines.

To generate the angle of the treadbase (103) relative to the floor stand (101), there is provided underneath the treadbase (103) a lifting mechanism (200). This serves to move the front end of the treadbase (103) upward and away from the front of the floor stand (101) while a rear point connection will keep the rear end of the treadbase (103) at generally the same relative position to the floor stand (101). It should be recognized that the rear ends of the treadbase (103) and floor stand (101) may not stay at exactly the same relative position as mechanical requirements to engage the motor (111), to avoid structures, or simply to relatively adjust other components may require a relatively small relative motion compared to other components. However, the relative motion of the rear ends of the treadbase (103) and floor stand (101) will generally be significantly less than the relative motions of the front ends so as to result in incline.

The first embodiment of the lifting mechanism (200) is visible in greater detail in FIG. 3 through 5, and FIGS. 9-10 provide for a second embodiment. Generally, the lifting mechanism (200) utilizes two interlinked arm structures to perform the lifting. The extension arm (201) comprises an extendable structure such as, but not limited to, a screw drive or worm screw or a hydraulic or pneumatic cylinder. The extension arm (201) is attached (generally through a rotational coupling, but that is not required) at a first end to a drive motor (211) which is generally rigidly mounted to the underside of the tread base (103). The other end of the extension arm (201) is rotationally attached to an intermediate point (221) of the rigid arm (203). The rigid arm (203) comprises two outrider arms (231) which are rotationally coupled to the underside of the treadbase and a plurality of stiffeners (233) which are attached to various components between them. This allows for the rigid arm (203) to provide connection at points laterally spaced across the belt movement direction of the treadbase (103) while allowing the extension arm (201) to be a single arm of standard design when acting as a vertical lift.

The rigid arm (203) is not rotationally attached to the floor stand (101), but is allowed to slide, roll, or otherwise linearly translate relative to the floor stand (101). In the embodiment of FIGS. 1-5, the rigid arm (203) is attached via an axle (235) and two wheels (237) to the floor stand (101). As can be best seen in FIG. 3, the wheels (237) are provided within an enclosed raceway (207) which is rigidly attached to the frame of the floor stand (101). This arrangement serves to interconnect the treadbase (103) and floor stand (101) with a sliding couple. In an alternative embodiment, the sliding motion may be accomplished by structures other than wheels (237) in a raceway (207), but the general motion is the same. Further, while, FIGS. 1-5 show the raceway (207) arranged horizontally (parallel with the floor stand (101)) this is not required and the raceway (207) may be placed at an angle to the floor stand (101).

Figure 9:
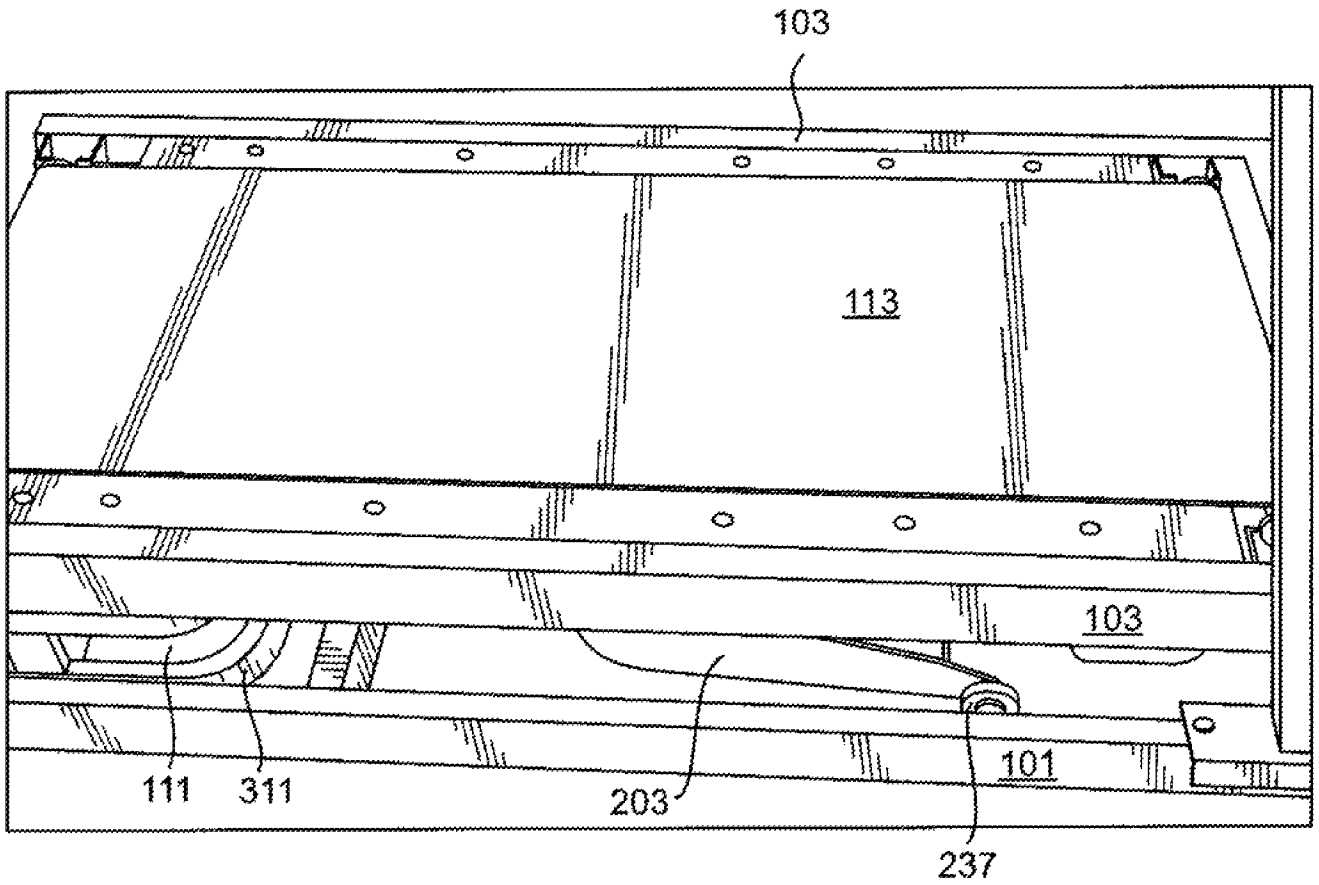
FIG. 9 shows a side view of another embodiment of a high-incline treadmill.
Figure 10:
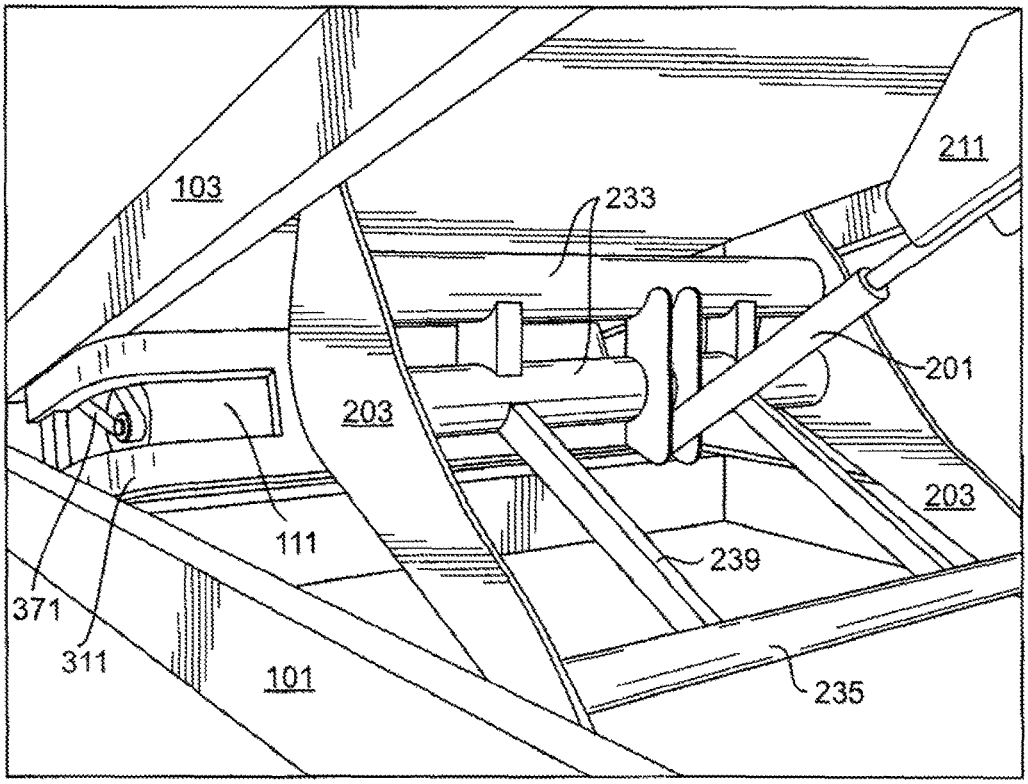
FIG. 10 shows an underside view of the embodiment of FIG. 9 showing the lift mechanism.
Figure 11:
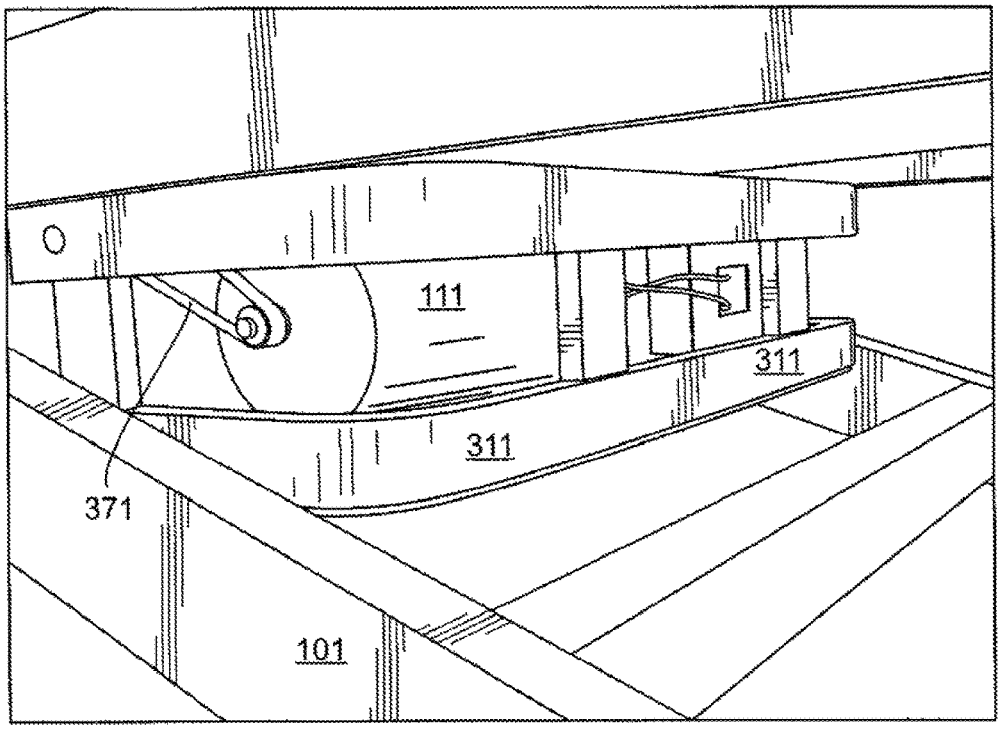
FIG. 11 shows another underside view of the embodiment of FIG. 9 which shows the motor cage.

It should be noted, however, that the floor stand (101) is not actually attached to the rigid arm (203). The rigid arm (203) is actually free floating relative to the floor stand (101). However, because the raceway (207) is generally of similar size to the enclosed wheel (237) (and or may contact the axle (235)), the wheel (237) will contact the raceway (207) at certain points depending on applied force and this temporary contact can result in the floor stand (101) and treadbase (103) behaving as an interconnected unit. In the embodiment of FIGS. 9-10, the wheels (237) are allowed to roll freely on the floor and no raceway (207) is provided.

This alternative arrangement can be desired as it allows for the floor stand (101) and treadbase (103) to move independent of each other, but this can allow for a user to potentially raise the front of the floor stand (101) of the floor if it is not sufficiently weighted as the mass of the treadbase (103) and user will not resist such movement. When a raceway (207) is used, the movement between the floor stand (101) and treadbase (103) is still independent, but is constrained within certain parameters and movement of the floor stand (101) by the user generally requires them to also shift the mass of the treadbase (103) and themselves making this substantially more difficult.

In operation, the mechanism (200) will generally work as follows. To increase the incline of the treadbase (103), the motor (211) will be actuated to extend the extension arm (201). As the extension arm (201) is forced to extend by the motor (211), relative motion of the other components will be forced to occur. Depending on the relative resistance, the extension will either serve to push the motor (and, thus, the attached front end of the treadbase (103)) away from the support (233) to which it is attached (which effectively rotates the rigid arm (203) relative to the treadbase (103) and pushes the treadbase (103) upward from the floor), or the wheel (237) will be forced to roll backward in the raceway (207) if the wheel (237) is forced to move, the rigid arm (203) will be pushed to a more upright position, which also serves to push the front end of the treadbase (103) upward. It should be noted that which type of movement will occur at any instant does not matter and generally both motions will occur in smooth transition depending on which motion currently meets the least resistance and both types of motion together will serve to raise the treadbase (103).

As should be apparent from the above and the attached figures, the raising motion of the treadbase (103) is based on two distinct and interrelated actions. The first is the rotation of the rigid arm (203) relative to the surface upon which the floor stand (101) rests and the linear movement of the wheels (237) backward. The second is the extension of the extension arm (201) and its forcing of the motor (and attached treadbase (103)) upward and away from rigid arm (203). However, this later motion is inhibited because boil the motor (211) and extension arm (201) are rigidly attached at a fixed distance from each other to the treadbase (103) which causes the rigid arm (203) to rotate relative to the treadbase (103). Thus, the extension serves to create incline by requiring the rigid arm (203) to tilt relative to the treadbase (103) and to move the base of the rigid arm (203) backwards.

This dual raising motion provides for significantly more control and a generally more rigid raising motion than devices of the prior art it also allows the treadbase (103) to rotate without having to slide the back end of the treadbase (103) along the floor in any substantive way. Specifically, it should be apparent that the treadbase (103) is supported towards its front end at two distinct points along its length at all points in travel. The treadbase (103) is also supported at its rear end by the pivot forming the rotational point. This is significantly different from prior designs which only supported the treadbase (103) at a single point toward the rear of the treadbase (103) in addition to the rotational point. Further, prior designs often moved that single connection point toward the rear of the treadbase (103) during incline.

The two points of attachment (where the rigid arm (203) and the motor (211) connect), as well as the rotation point in the rear, will generally remain the same distance apart at all points in incline travel providing a more rigid support platform. That is, the points at which the treadbase (103) is supported do not move relative to each other and thus the treadbase (103) is supported at the same points regardless of incline. This is as opposed to other designs where a forward position would generally result in the front connection to the treadbase (103) moving rearward when the treadbase (103) is lifted. The present design, thus, generally maintains the same amount of support for the front end of the treadbase (103) when the treadbase (103) is in its most raised position as it does when the treadbase (103) is in its lowered position and at all points in between.

It should be recognized that the lifting mechanism (200) is also quite different from prior designs because the lifting motor (211) is lifted with the treadbase (103) and does not remain on the floor stand (101). While this can make the treadbase (103) heavier, it can also provide for improved rigidity of support as the treadbase (103) includes much more structure. Still further, use of a rolling connection in a confined raceway at the floor stand (101), means that the shortening dimension is generally at the floor stand (101) as opposed to the treadbase (103).

It should be recognized that depending on the embodiment, the use of the raceway (207) may or may not be desirable. In an alternative embodiment, the wheels (237) could be allowed to roll along the floor as shown in the embodiment of FIG. 9-10 or along a simple track. However, the raceway (207) is generally preferred as it provides for specifically confined motion of the wheel (237) and serves to provide additional rigidity inhibiting the outrider arms (231) from torqueing during the raising and lowering process. For that reason, the raceway (207), as shown in the FIGS, serves to tightly confine the wheel (237) to a very limited and particular path of motion.

It should also be recognized that in a still further embodiment, the treadbase (103) and the floor stand (101) or floor could actually be rotationally connected. In this arrangement, the wheels would be eliminated and rigid arm (203) would be placed at a fixed point (either mounted to the floor stand (101) or on the floor. This arrangement lacks the dual motion of the previously described embodiments and instead utilizes the extension of extension arm (201) as a force to move the extension arm (201) and rigid arm (203) from a more "V" shaped position to a more co-linear position (spreading of the arms of the V). While this motion is generally simpler, it is not believed to be as smooth, and it will likely generate more bounce as the arms of the V spread more. Thus, it is generally preferred that the treadbase (103) not be rotationally coupled to the floor stand (101) or floor, but instead be coupled via a sliding or rolling arrangement as depicted in the various embodiments.

Figure 6:
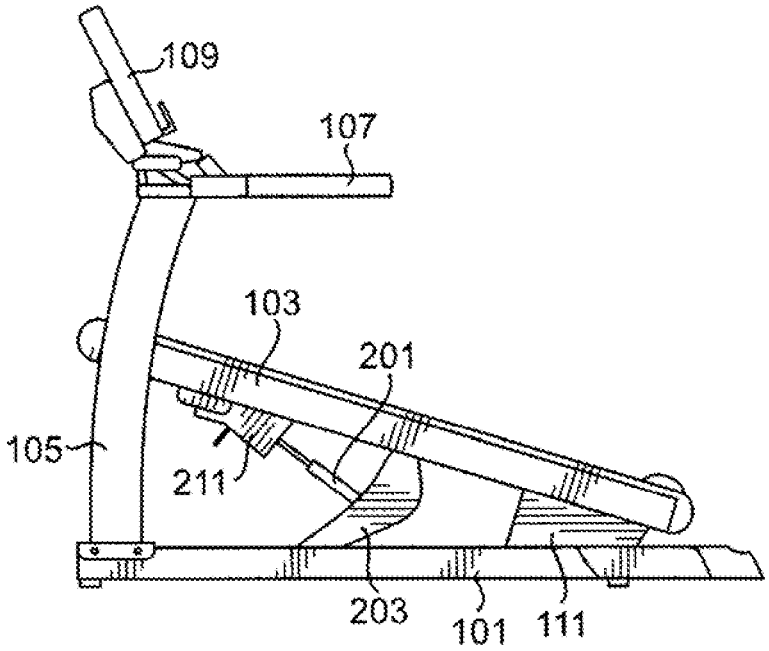
FIG. 6 shows the position of a lift mechanism in a high-incline treadmill at a raised position.
Figure 7:
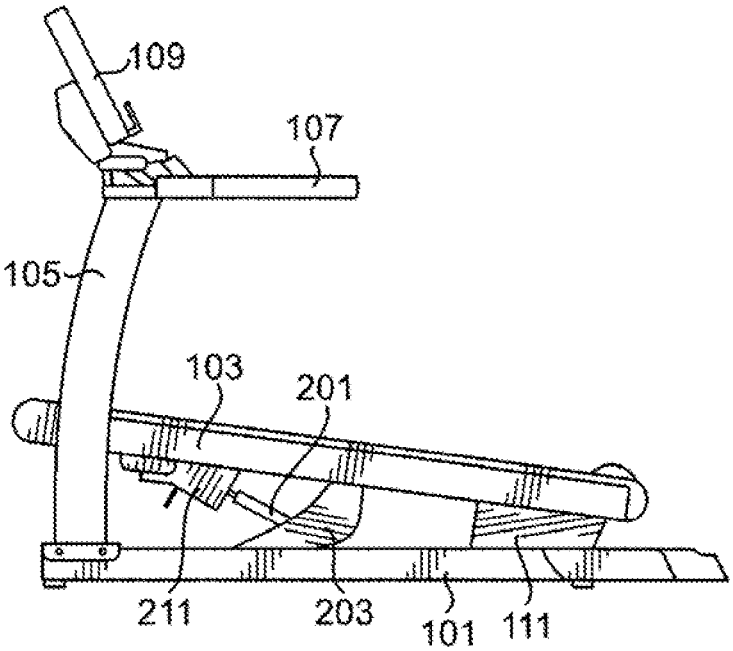
FIG. 7 shows the position of the lift mechanism in a high-incline treadmill at an intermediate position.
Figure 8:
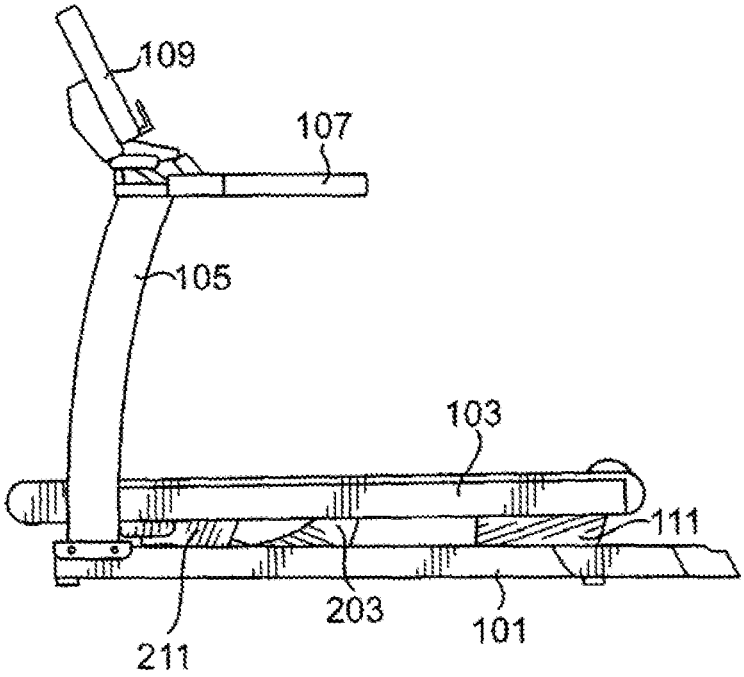
FIG. 8 shows the position of the lift mechanism in a high-incline treadmill at a lowered or neutral position.

FIGS. 6 through 8 illustrate the motion of the lift mechanism (200) of the embodiment of FIG. 1-5 through a range of different inclines. In FIG. 6, the treadbase (103) is depicted at a high-incline position (a position above 15 percent, or above 20 percent, or above 30 percent) which can be considered a raised position. Note that the maximum incline of any treadmill (100) is not necessarily depicted, the FIG. simply illustrates an exemplary raised position. As can be seen the extension arm (201) is extended and clearly elongated in this position. Further, the rigid arm (203) is tilted upward since the wheel (not visible) is at a point leather hack on the floor stand (101). In the middle position of FIG. 7, which depicts the treadbase (103) at an intermediate point which would generally be at a standard incline (between 0 and 15 percent), the extension arm (201) is clearly shorter and the rigid arm (203) has rotated downward with the wheel moved more toward the front of the floor stand (101). Finally, in FIG. 8 the treadbase (103) is in its neutral position which is generally around 0% inclination but can be lower (declined) by as much as 3 or 5%. In this FIG, the rigid arm (203) is fully lowered with the wheel (237) at the front most point of the raceway (207). The extension arm (201) is also its shortest length.

While a declined position may appear counter-intuitive for exercise purposes, it can be desirable as it can allow the treadmill (100) to better mimic actual hiking, walking, or climbing conditions where paths of generally continuous assent will still commonly include periodic declines due to natural terrain conditions. As an example, in order to improve the interest of walking on a treadmill, some treadmills can be programmed to provide a "path" where the treadmill mimics the contours of an existing path. For example, the user could program the treadmill to present the actual (or specifically modified) inclines (and declines) of Barr Trail to ascend Pikes Peak. This can allow the user of the treadmill to have a goal to climb an actual mountain during one or more exercise sessions which can provide for a far more interesting exercise goal than to simply walk 15 miles. Further, mimicking natural terrain patterns can also provide the user with a varied workout which can potentially improve results from the exercise.

As can be seen from the FIGS, the position of the motor (211) and the attachment point of the rigid arm (203) to the treadbase (103) do not move relative to each other, or relative to the treadbase (103) across all the FIGS. 6-8 providing for a much broader support or the treadbase (103) than a single moving point. This will generally impart more rigidity to the treadbase (103) and result in a high-incline treadmill (100) which does not suffer from increased wobble or shaking of the treadbase (103) at higher inclines than at lower ones, particularly for steps impacting toward the front of the treadbase (103) as may be the case for a user with a longer stride.

In the embodiment of FIGS. 1-5 the motor is connected to the floor stand (101) and therefore the axle of the rear roller (103) is effectively the point of incline. That is, the treadbase (103) is rotated upward about the axle of the roller (133) at the rear. While this can be very effective as it allows for incline to be generated at a component which is already designed to rotate, in an alternative embodiment the motor (111) is mounted in a cage (311) attached to the treadbase (103) which allows the motor to rotate with the treadbase (103). This is best shown in the embodiments of FIGS. 9-12. While the motor (111) will generally utilize a pulley or belt (371) as the transmission between the motor (111) and the rear roller (133) which can operate at any angle, maintaining a constant relative position between the motor (111) and roller (133) can provide for a smoother rotation of the belt (113) throughout all points of operation.

Mounting the motor (111) on the treadbase (103) in a cage (311) can also provide for some interesting benefits in design. In the first instance, it becomes possible to utilize the same motor (111) to generate both rotational motion of the belt (113) and the extension of the extension arm (201) by providing an appropriate gearing and transmission. In the embodiment of FIGS. 9-12, the pivot point about which the treadbase (103) rotates is located under the treadbase (103). In particular, the treadbase (103) effectively rests on top of the cage (311) and the bottom of the cage (311) is rotationally connected to the floor stand (101). This presents some additional design benefits as the treadbase (103), therefore, rotates about a point it is vertically spaced above. This arrangement results in a difference in movement of feel as the treadbase (103) rotates versus when the treadbase rotates about its rear roller (133) axle. Specifically the rear top of the cage (311) will effectively move horizontally rearward and vertically downward as the treadbase rotates and the treadbase (103) will be pushed into the user's feet as the incline is increased.

It is preferred, but not required, that the point of rotation for the cage (311), and thus the treadbase (103), be located horizontally behind the axle of the rear roller (133). In the event that the rotation point is horizontally in front of the rear roller (133) or at the same horizontal position as the rear roller (133), when the treadbase (103) is inclined, the rear roller (133) tends to move sharply rearward and downward as soon as the incline begins and the treadbase (103) rotates about the pivot. This can result in an unstable feel as the rear roller (133) is actually moving away (downward) from the user as the belt (113) is rotating in a similar direction (declined). Thus, it can feel like the belt (113) is slipping or speeding up during the active incline movement.

By locating the rotation point horizontally behind the rear roller (133), the rotational motion results in a generally horizontal initial movement. This serves to push the belt (113) against the user's feet, but does not result in it dropping away as quickly eliminating any perceived speed differentiation (even though the speed has not changed). Downward movement of the rear roller (133) is generally substantially reduced or eliminated. Still further, having the rotation point be behind the roller (133) generally results in the floor stand (101) being longer than the treadbase (103). This both makes for a more stable floor stand (101) and generally positions all the belt (113) above the floor stand (101) at all times and at all inclines. The belt (113) does not end up hanging off the back of the floor stand (101) which can provide for an increased feeling of rigidity and solidity.

Particularly for a user who may be walking further down the belt (113), that is, toward the rear, when the belt (113) is extended beyond the floor stand, the treadmill (100) can feel weak, flimsy, "bouncy", or as if it might flip over due to the position of the relative mass of the user to the floor stand (101). While movement of the treadmill (100) is generally unlikely in this scenario clue to its mass relative to that of the user, perceived issues in this area can result in an unpleasant exercise experience. Particularly at high incline, where a user can feel more unstable simply due to the incline, perception of the device as having a strong support can be very important to provide for user comfort and thus regular use of the treadmill (100).

Figure 12:
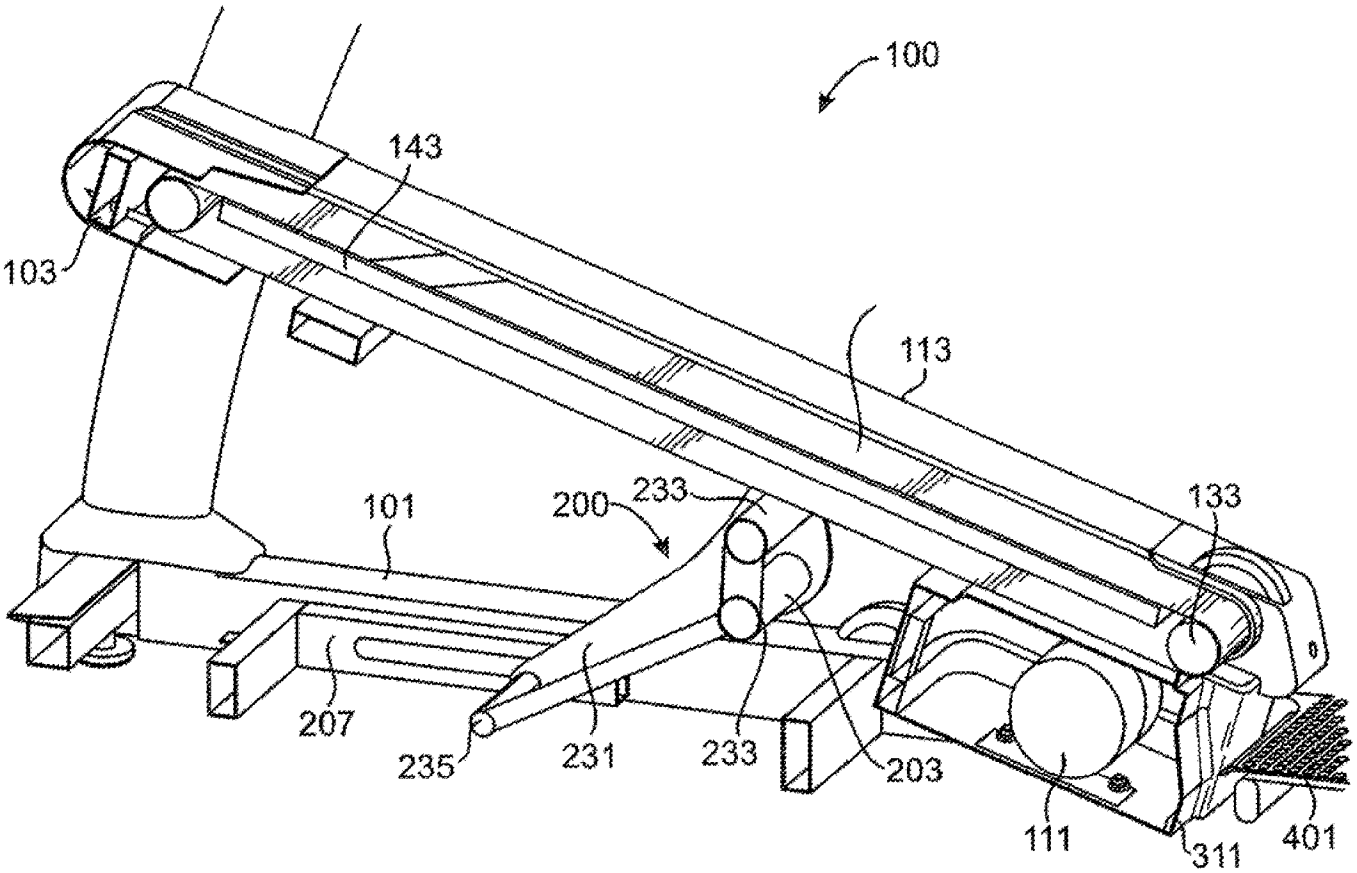
FIG. 12 shows a cut-away view of another embodiment of a high-incline treadmill which provides for a sturdier footprint.

Positioning the rotation point behind the axle of the rear roller (133) can provide for another benefit. Because the treadbase (103) is generally positioned in the air, it can be desirable to provide a step (401) for a user to utilize to get up on the treadbase (103). For space reasons, it will generally be preferred that the step (401) be at the rear of the treadmill (100) as this is the most common way user's will step on and off treadmills, particularly in gym or fitness center settings where treadmills are commonly placed very close together side-by-side. An embodiment of such a step (401), which will be discussed in additional detail later in this disclosure is shown in FIGS. 12 and 13.

As can be seen in FIGS. 1-8, if the rear roller (133) is positioned behind the rotation point, there is a pinch point created between the step (401) and the rear roller (133) when the treadbase (103) is tilted to its high angle. Specifically, as the rear roller (133) will descend as the angle increases, the space between the rear roller (133) and the step (401) will decrease. While it is understood that with basic part selection the rear roller (133) and step (401) will not hit regardless of rotation, the pinch point presents a particular concern. Specifically, as the belt (113) is rolling over the rear roller (133) from top to bottom, should something contact the rear roller (133), it will generally be forced under the treadbase (103). This is generally into the pinch point and therefore presents a high concern for a potential injury from someone using the treadmill (100) if they were to, for example, fall off the back of the treadbase (103) and not be utilizing the industry standard pull key safety mechanism. It could also harm a bystander who may stand on the step (401) while a different user is using the treadmill (100). This could, for example, be a trainer reviewing a workout, or a child investigating what a parent is doing.

By placing the rotation point behind the rear roller (133), this pinch point is generally eliminated as the rear roller (133) does not readily descend (at least not nearly as far) toward the stair (401). Further any pinch point created underneath the treadbase (103) due to the movement of the cage (311) can be more readily blocked through the use of a static block at the base (101). Thus, a potential point of injury is dramatically reduced or eliminated and the stair (401) becomes readily useable for an observer of the user of the treadmill (100) to stand on, even when the treadmill (100) is in use. This can become particularly important if a spotter is needed for the user as may be the case with a less stable user such as, for example, if the treadmill (100) was being used for physical therapy sessions.

Figure 13:
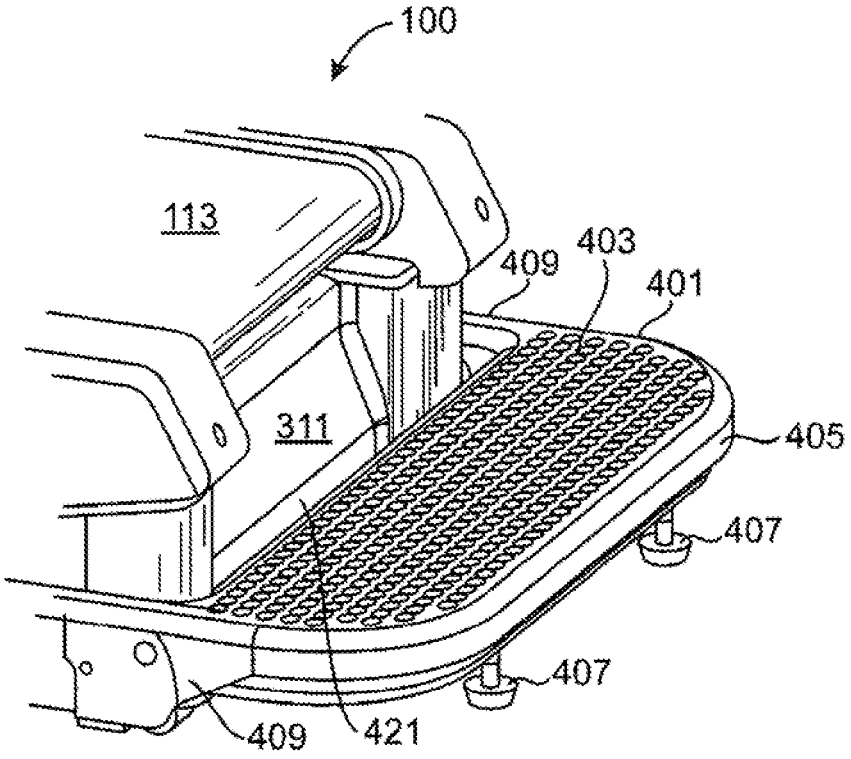
FIG. 13 provides for an embodiment of a removable step suitable for use on the rear of a high-incline treadmill.
Figure 14:
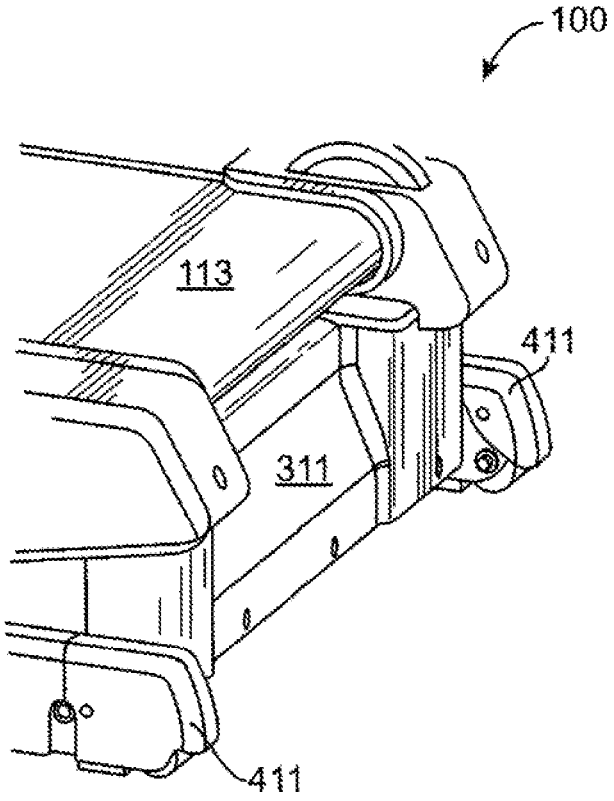
FIG. 14 provides for the embodiment of FIG. 13 which the step removed and bumper's placed over the connection points.

As contemplated above, FIG. 13 provides for details of an embodiment of a rear stair (401). In this particular embodiment, the stair (401) is removable and FIG. 14 shows the rear of the treadmill (100) with the stair (401) removed and with cover bumpers (411) in place to cover the connection point. It is not required that the stair (401) be removable and in another embodiment it may be fixed in place. However, it will generally be preferable to supply a removable stair (401) as certain locations where the treadmill (100) may be placed will have a smaller area in which to place the footprint of the treadmill (100). As indicated above, with a rotational point that is mounted behind the rear roller (133), for a belt with an industry standard length, the treadmill (100) will generally already have a longer floor stand (101) than comparable treadmills, and therefore the ability to not use the step (401) in certain circumstances would generally be desirable.

As can be seen in FIG. 13, the step (401) is generally of a standard design having a textured foot pad (403) mounted to the upper surface of a generally solid or otherwise rigid main body (405). The step (401) may include leveling feet (407) underneath to allow for the stair (401) to be positioned solidly even on an uneven surface. It is generally preferred that the floor stand (101) have as few points of contact with the floor as possible and this will generally be from having feet at the four corners of the floor stand (101). Reduced contact with the floor is desirable as it can make the device more stable if the underlying surface is uneven. This is part of the reason why the embodiment of the rigid arm (203) of FIGS. 1-8, which utilizes the raceway (207) is preferred over the rigid arm (203) of FIGS. 9-11 which does not.

The step (401) will generally connect to the treadmill (100) via two sheaths (409) that will at least partially enclose an end of each of the sides of the floor stand (101). In an embodiment the sheaths (409) may simply slip over the ends to position the step (401) and need not be bolted, screwed, or otherwise attached to the floor stand (101) with any fasteners. That is, in an embodiment, the step (401) is held in place substantially only with friction or similar physical phenomena. In an alternative embodiment, screws, bolts, or other fasteners are used to secure the sheaths (409) in place.

As should be apparent in FIG. 13, there is a possibility of their being a pinch point created in the gap (421) between the cage (311) and the front of the step (401). However, because of the way the rotation is setup with the point of rotation behind the axle of the rear roller (133), this is generally fairly small and it is generally not particularly easy for a user's foot to get caught in it. Further, because the gap (421) is spatially separated from the belt (113), the belt (113) will usually not serve to force anything into the gap (421) should it contact the rear of the belt. This is as opposed to the alternative where the pinch point is created between the belt (113) and the step (401).

As shown in FIG. 14, if the step (401) is not attached to the treadmill (100), the ends of the sides of the base (101) may be covered, both to reduce any potential sharp corners and for improved aesthetics, with cover bumpers (411). These can provide for smoothed corners and can act to both protect the user from coming into contact with the internal metal components of the floor stand (101), and to protect the internal components of the floor stand (101) from any damage from being kicked or hit.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

The invention claimed is:

1. A treadmill comprising:

a floor stand;

treadbase including an endless belt thereon;

a motor for moving the endless belt; and a lifting mechanism for rotating the treadbase relative to the floor stand about a point of rotation, the lifting mechanism comprising:

a lift motor attached at a fixed position to the treadbase;

an extension arm attached at a first end to a fixed position on the treadbase, the extension arm increasing and decreasing in length based on action of the motor;

a rigid arm attached at a first end to a fixed position on the treadbase, a second end of the extension arm being attached to the rigid arm at a fixed position on the rigid arm; and two wheels on the rigid arm;

wherein when the lift motor is activated to increase the length of the extension arm, the increase in the length of the extension arm causes the wheels on the rigid arm to roll relative to the floor stand thus altering the angle of the rigid arm relative to the floor stand and causing the treadbase to incline.

2. The treadmill as claimed in claim 1, wherein the wheels roll on a surface upon which the floor stand is resting.

3. The treadmill as claimed in claim 1 wherein the wheels are within an enclosed raceway attached to the floor stand.

4. The treadmill as claimed in claim 1 wherein the treadbase inclines by rotating about a rotation point.

5. The treadmill as claimed in claim 4 wherein the endless belt rotates on the treadbase about a front roller and a rear roller.

6. The treadmill as claimed in claim 5, wherein the rotation point is located horizontally behind an axle of the rear roller.

7. The treadmill as claimed in claim 1, wherein the rotation point is located vertically below the axle of the rear roller.

8. The treadmill as claimed in claim 1, wherein the treadbase inclines to a greater than 15% incline.

9. The treadmill as claimed in claim 1, wherein the treadbase inclines to a greater than 20% incline.

10. The treadmill as claimed in claim 1, wherein the treadbase inclines to a greater than 25% incline.

11. The treadmill as claimed in claim 1, wherein the treadbase inclines to a greater than 30% incline.

* * * * *